US008418479B2

(12) United States Patent
Xu et al.

(10) Patent No.: US 8,418,479 B2
(45) Date of Patent: Apr. 16, 2013

(54) CO-AXIAL MULTI-STAGE PULSE TUBE FOR HELIUM RECONDENSATION

(75) Inventors: Mingyao Xu, Emmaus, PA (US); Ralph Longsworth, Allentown, PA (US)

(73) Assignees: Sumitomo Heavy Industries, Ltd., Tokyo (JP); Sumitomo (Shi) Cryogenics of America Inc., Allentown, PA (US)

( * ) Notice: Subject to any disclaimer, the term of this patent is extended or adjusted under 35 U.S.C. 154(b) by 685 days.

(21) Appl. No.: 12/357,495

(22) Filed: Jan. 22, 2009

(65) Prior Publication Data

US 2009/0173083 A1 Jul. 9, 2009

Related U.S. Application Data

(63) Continuation of application No. 11/274,447, filed on Nov. 15, 2005, now Pat. No. 7,497, 084.

(60) Provisional application No. 60/641,199, filed on Jan. 4, 2005.

(51) Int. Cl.
*F25B 9/00* (2006.01)
*B01D 8/00* (2006.01)

(52) U.S. Cl.
USPC ..... 62/6; 62/55.5

(58) Field of Classification Search ..... 62/6, 55.5; 60/517, 520
See application file for complete search history.

(56) References Cited

U.S. PATENT DOCUMENTS

| | | | | |
|---|---|---|---|---|
| 3,119,237 | A | 1/1964 | Gifford | |
| 3,237,421 | A | 3/1966 | Gifford | |
| 4,484,458 | A | 11/1984 | Longsworth | |
| 4,606,201 | A | 8/1986 | Longsworth | |
| 5,107,683 | A | 4/1992 | Chan et al. | |
| 5,295,355 | A * | 3/1994 | Zhou et al. | 62/6 |
| 5,303,555 | A | 4/1994 | Chrysler et al. | |
| 5,488,830 | A * | 2/1996 | Burt | 62/6 |

(Continued)

FOREIGN PATENT DOCUMENTS

| | | |
|---|---|---|
| JP | 61-223454 | 10/1986 |
| JP | 4-320765 | 11/1992 |

(Continued)

OTHER PUBLICATIONS

"Pulse Tube Oxygen Liquefier", E.D. Marquardt and Ray Radebaugh, National Insititute of Standards and Technology Adv. Cryogenic Engineering vol. 45, Plenum (2000) pp. 457-464.*

(Continued)

*Primary Examiner* — Frantz Jules
*Assistant Examiner* — Keith Raymond
(74) *Attorney, Agent, or Firm* — Katten Muchin Rosenman LLP

(57) ABSTRACT

A two-stage pulse tube refrigerator having a compact design, low vibration and low heat loss is provided where at least the $2^{nd}$ stage is co-axial but preferably, both stages are co-axial with the second stage pulse tube being central and the first stage pulse tube occupying the annular space between the second stage pulse tube and the first stage regenerator. Convection losses associated with different temperature profiles in the pulse tubes and regenerators are minimized by shifting the thermal patterns in the pulse tubes relative to the regenerators by one or more of spacers in the regenerators, physical differences in length with gas channel connections, adjustment of dc flow, and thermal bridges.

10 Claims, 7 Drawing Sheets

U.S. PATENT DOCUMENTS

| | | | | |
|---|---|---|---|---|
| 5,613,365 | A | 3/1997 | Mastrup et al. | |
| 5,680,768 | A | 10/1997 | Rattray et al. | |
| 6,167,707 | B1 * | 1/2001 | Price et al. | 62/6 |
| 6,196,005 | B1 | 3/2001 | Stautner | |
| 6,256,998 | B1 | 7/2001 | Gao | |
| 6,438,967 | B1 * | 8/2002 | Sarwinski et al. | 62/6 |
| 6,484,515 | B2 | 11/2002 | Kim et al. | |
| 6,490,871 | B1 * | 12/2002 | Stautner | 62/51.1 |
| 6,619,046 | B1 | 9/2003 | Mitchell | |
| 6,813,892 | B1 * | 11/2004 | Olson et al. | 62/6 |
| 7,114,341 | B2 * | 10/2006 | Gao | 62/6 |
| 7,434,407 | B2 * | 10/2008 | Haberbusch et al. | 62/6 |
| 7,497,084 | B2 * | 3/2009 | Xu et al. | 62/6 |
| 2005/0011200 | A1 * | 1/2005 | Longsworth | 62/6 |
| 2005/0103025 | A1 | 5/2005 | Stautner et al. | |

FOREIGN PATENT DOCUMENTS

| | | |
|---|---|---|
| JP | 5-141796 | 6/1993 |
| JP | 5-141798 | 6/1993 |
| JP | 07-260269 | 10/1995 |
| JP | 2000-230459 | 8/2000 |
| JP | 2000-249414 | 9/2000 |
| JP | 2001-272126 | 10/2001 |
| JP | 2002-39640 | 2/2002 |
| JP | 2004-286430 | 10/2004 |
| JP | 2004-294041 | 10/2004 |
| WO | 03036190 | 5/2003 |
| WO | 03036207 | 5/2003 |

OTHER PUBLICATIONS

"Experimental Investigation of G-M Type Coaxial Pulse Tube Cryocooler" K.Yuan, J.T. Liang, Y.L. Ju, Cryogenic laboratory, Technical Institute of Physics and Chemistry, Chinese Academy of Sciences, Beijing, P.R. China Cryocoolers vol. 12, pp. 317-323, Kluwar Academic/Plenum Publishers, 2003.*

"Research of Two-Stage Co-Axial Pulse Tube Coolers Driven by a Valveless Compressor" L.W. Yang, J.T. Liang, Y. Zhou, and J.J. Wang, Cryogenic Laboratory, Chinese Academy of Sciences Beijing, China Cryocoolers vol. 10, pp. 233-238, Kluwar Academic/Plenum Publishers, 1999.*

Chinese Office Action dated Jan. 31, 2011 from the corresponding Chinese Application.

Japanese Office Action dated Mar. 2, 2010, from the corresponding Japanese Application.

* cited by examiner

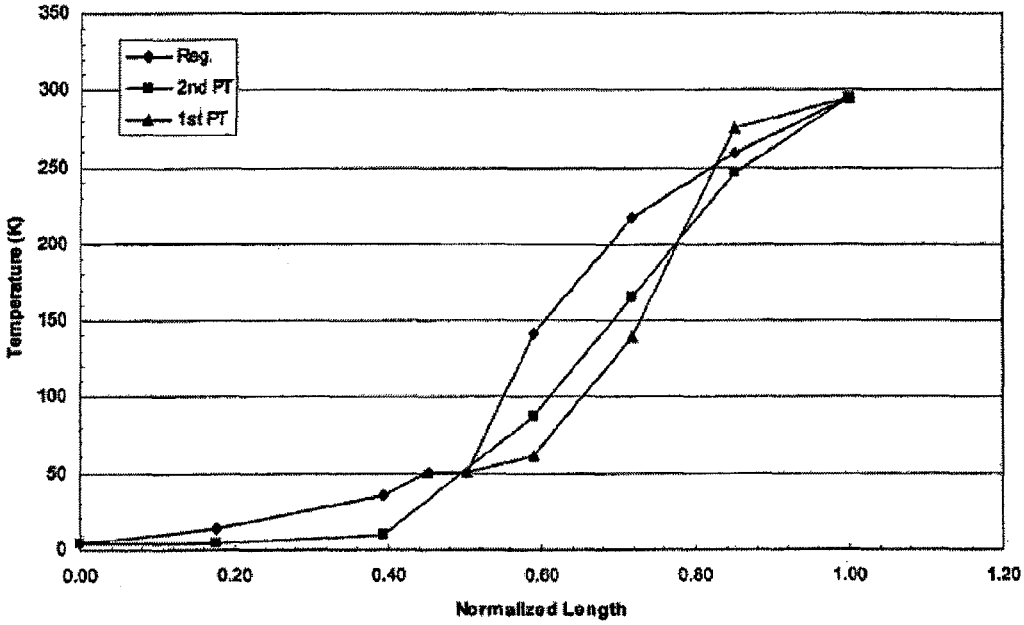
PRIOR ART
Fig. 3a Temperature profile in a two-stage 4 K pulse tube in vacuum
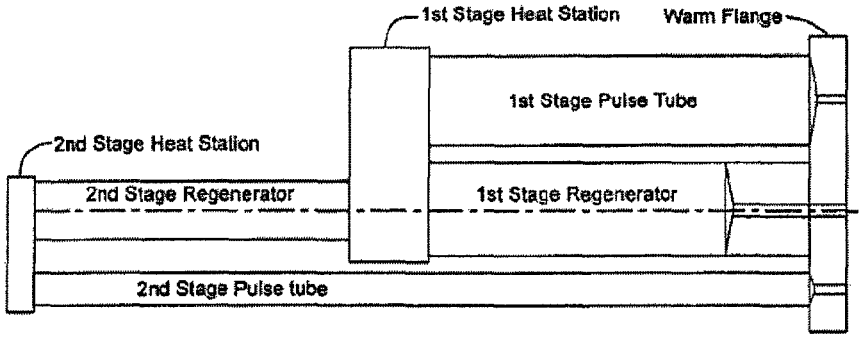
PRIOR ART
Fig. 3b Conventional two-stage 4 K pulse tube

CO-AXIAL MULTI-STAGE PULSE TUBE FOR HELIUM RECONDENSATION

CROSS REFERENCE TO RELATED APPLICATION

This application is a continuation of U.S. patent application Ser. No. 11/274,447, filed on Nov. 15, 2005, which claims priority from U.S. Provisional Application No. 60/641,199, filed Jan. 4, 2005, which is hereby incorporated by reference in its entirety.

BACKGROUND OF THE INVENTION

The present invention relates to multi-stage Gifford McMahon (GM) type pulse tube refrigerators as applied to recondensing helium in a MRI magnet. GM type refrigerators use compressors that supply gas at a nearly constant high pressure and receive gas at a nearly constant low pressure to an expander. The expander runs at a low speed relative to the compressor by virtue of a valve mechanism that alternately lets gas in and out of the expander. Gifford in U.S. Pat. No. 3,119,237 describes a version of a GM expander with a pneumatic drive. The GM cycle has proven to be the best means of producing a small amount of cooling below about 20 K because the expander can run at 1 to 2 Hz.

A Pulse Tube refrigerator was first described by Gifford in U.S. Pat. No. 3,237,421, which shows a pair of valves, like the earlier GM refrigerators, connected to the warm end of a regenerator, which in turn is connected at the cold end to a pulse tube. Early work with pulse tube refrigerators in the mid 1960s is described in a paper by R. C. Longsworth, '*Early pulse tube refrigerator developments*', Cryocoolers 9, 1997, p. 261-268. Single-stage, two-stage, four stages with interphasing, and co-axial designs were studied. All had the warm ends of the pulse tube closed and all but the co-axial design had the pulse tubes separate from the regenerators. While cryogenic temperatures were achieved with these early pulse tubes the efficiency was not good enough to compete with GM type refrigerators. U.S. Pat. No. 4,606,201 by Longsworth describes a different type of pneumatic drive for a GM type expander that uses gas flowing through an orifice to and from a buffer volume to control the displacer.

A significant improvement was reported by E. I. Mikulin, A. A. Tarasow and M. P. Shkrebyonock, '*Low temperature expansion (orifice type) pulse tube*', Advances in Cryogenic Engineering, Vol. 29, 1984, p. 629-637 in 1984, and a lot of interest ensued in looking for further improvements. This initial improvement used an orifice and a buffer volume connected to the warm end of the pulse tube to control the motion of the "gas piston" in the pulse tube to produce more cooling each cycle. In effect the gas piston replaced the solid piston, often referred to as a displacer, in U.S. Pat. No. 4,606,201. Subsequent work focused on both means to improve the control of the gas piston and on improving the configuration of the pulse tube expander. S. Zhu and P. Wu, '*Double inlet pulse tube refrigerators: an important improvement*' Cryogenics, vol. 30, 1990, p. 514, describe a double orifice means of controlling the gas piston.

Gao, U.S. Pat. No. 6,256,998 describes a means of controlling the gas pistons in a two-stage pulse tube that works well at 4 K. Chan et al in U.S. Pat. No. 5,107,683 describe the extension of the second stage of a pulse tube from the second stage heat station to ambient temperature. This concept is one of several configurations studied by J. L. Gao and Y. Matsubara, '*Experimental investigation of 4 K pulse tube refrigerator*', Cryogenics 1994 Vol. 34, p. 25 that has proven to work well for two-stage 4 K pulse tubes. The arrangements that were studied all had the pulse tubes separate from the regenerators.

A co-axial pulse tube with single orifice control was reported in 1986 by R. N. Richardson. '*Pulse tube refrigerator-an alternative cryocooler*?' Cryogenics, 1986, 26(6): p. 331-340. Inoue et al in JP HO7-260269 describe a two-stage pulse tube in which the regenerators and pulse tubes are co-axial. The design has the second stage pulse tube in the center, extending from the second stage heat station to ambient temperature, surrounded by the first and second stage regenerators. The first stage pulse tube is a co-axial annular volume on the outside of the first stage regenerator. The central feature of this patent is the placement of heat exchangers within the pulse tubes to help equalize the temperature profiles in the pulse tubes with the temperature profiles in the regenerators. Temperature differences between the pulse tubes and the regenerators are not a problem when the tubes are separate from the regenerator and the pulse tube is surrounded by vacuum. The temperature differences however result in convective thermal losses when a conventional pulse tube is mounted in the helium atmosphere in the neck tube of a MRI cryostat.

Losses associated with temperature differences in co-axial pulse tubes were studied by L. W. Yang, J. T. Liang, Y. Zhou, and J. J. Wang, *Research of two-stage co-axial pulse tube coolers driven by a valveless compressor*, Cryocoolers 10, 1999, p. 233-238 and by K. Yuan, J. T. Liang, Y. L. Ju, *Experimental investigation of a G-M type co-axial pulse tube cryocooler*, Cryocoolers 12, 2001, p. 317-323. First they found it best to have the pulse tubes in the center surrounded by the regenerators in the annular space around the pulse tube. Losses were minimized by superimposing "dc" flow that brought warm gas down the pulse tubes over many cycles. When running in a vacuum they found that an external second stage pulse tube was more efficient than a co-axial second stage.

Mastrup et al., U.S. Pat. No. 5,613,365 describes a single stage concentric (co-axial) Stirling cycle pulse tube in which a central pulse tube has a thick wall made of low thermal conductivity material that provides a high degree of insulation from the annular regenerator on the outside. This idea was extended by Rattay et al., U.S. Pat. No. 5,680,768, in which the surrounding vacuum extends into a gap between the pulse tube wall and the inner wall of the regenerator.

Another means of insulating the wall of a pulse tube is described by Mitchell in U.S. Pat. No. 6,619,046. The advantages of the cold end heat exchanger in single stage co-axial pulse tubes are cited in Chrysler et al., U.S. Pat. No. 5,303,555, and by Kim et al., U.S. Pat. No. 6,484,515.

The problems associated with recondensing helium in a MRI magnet have been addressed by Longsworth in U.S. Pat. No. 4,606,201. A two-stage GM expander that has a minimum temperature of 10 K precools gas in a JT heat exchanger that produces cooling at 4 K. The JT heat exchanger is coiled around the GM expander so that the temperature of both the JT heat exchanger and the expander get progressively colder between the warm and cold ends. The expander assembly is mounted in the neck tube of a MRI magnet where it is surrounded by helium gas that is thermally stratified by virtue of being vertically oriented with the cold end down. The 4 K heat station has extended surface to recondense He. Refrigeration is transferred to cold shields in the MRI cryostat at two heat stations which are at temperatures of approximately 60 K and 15 K. Mating conical heat stations and bellows in the neck tube enable both heat stations to engage as the warm flange is bolted down and sealed with a face type "O" ring.

Longsworth, U.S. Pat. No. 4,484,458, had previously described the concentric GM/JT expander which had straight heat stations and a radial type "O" ring seal at the warm flange. This permits the expander to be moved axially to establish a desired position of the expander heat stations relative to the neck tube heat stations.

Advances in pulse tube technology and MRI cryostat design now make it possible to use a two stage pulse tube to cool a single shield at about 40 K and recondense helium at about 4 K. Two-stage pulse tube expanders are preferred over two-stage GM expanders because they have less vibration and thus generate less noise in the MRI signal. When a pulse tube of conventional design, with the pulse tubes parallel to the regenerators, is inserted into the neck tube of a MRI magnet it is found that helium gas in the neck tube circulates between the pulse tubes and the regenerators due to the temperature differences between them. This results in a serious loss of refrigeration.

Stautner et al., PCT patent application WO 03/036207 A2, explains the problem for a conventional two-stage 4 K pulse tube and offers a solution in the form of a sleeve that surrounds the pulse tube assembly and has insulation packed around the tubes. The sleeve has a heat station at about 40 K and a recondenser at the cold end and can be easily removed from the neck tube to be serviced.

Daniels et al., PCT patent application WO 03/036190 A1, offers another solution to the problem of convection losses of a conventional two-stage 4 K pulse tube in a MRI neck tube. Insulated sleeves around the pulse tubes and regenerators reduce convective losses when the pulse tube is mounted in the helium gas in a MRI neck tube.

One of the objects of this invention is to provide a design that reduces the vibration that is transmitted to an MRI cryostat by the expander.

It is an object of this invention to provide an easy way to remove the pulse tube expander for service.

It is an object of this invention to provide a co-axial design that is more compact than conventional parallel tube design.

It is an object of this invention to provide a method of eliminating convective losses due to heat transfer between the pulse tubes and regenerators.

It is a further object of this invention to provide a method for optimizing the design of a co-axial pulse tube.

SUMMARY OF INVENTION

A conventional two-stage pulse tube refrigerator has the pulse tubes and regenerators in separate parallel tubes. When mounted in the neck tube of a MRI cryostat the helium in the neck tube results in thermal losses due to convection because of the temperature differences between the pulse tubes and the regenerators. This invention discloses a novel way to eliminate the convection loss by having the regenerator be co-axial in the annular space around the pulse tube. At least the $2^{nd}$ stage is co-axial but preferably, both stages are co-axial with the second stage pulse tube being central and the first stage pulse tube occupying the annular space between the second stage pulse tube and the first stage regenerator. Means to minimize thermal losses between the pulse tubes and regenerators are also disclosed.

The present invention eliminates the convection losses associated with different temperature profiles in the pulse tubes and regenerators by using a two-stage pulse tube having at least one stage being co-axial with novel means to minimize the thermal losses between the pulse tubes and regenerators. While the main application is envisioned to be the recondensing of helium in a MRI cryostat by a two-stage GM type pulse tube it can also be applied to recondensing hydrogen and neon in cryostats that are designed for High Temperature Superconducting, HTS, magnets. At the higher temperatures it is also practical to have the pulse tube be connected directly to a compressor and operate in a Stirling cycle mode at a much higher speed.

BRIEF DESCRIPTION OF THE DRAWINGS

FIG. 3 shows the temperature profiles that are typical for a conventional two-stage 4 K GM type pulse tube that is surrounded by vacuum.

DETAILED DESCRIPTION OF THE INVENTION

Figure 1:
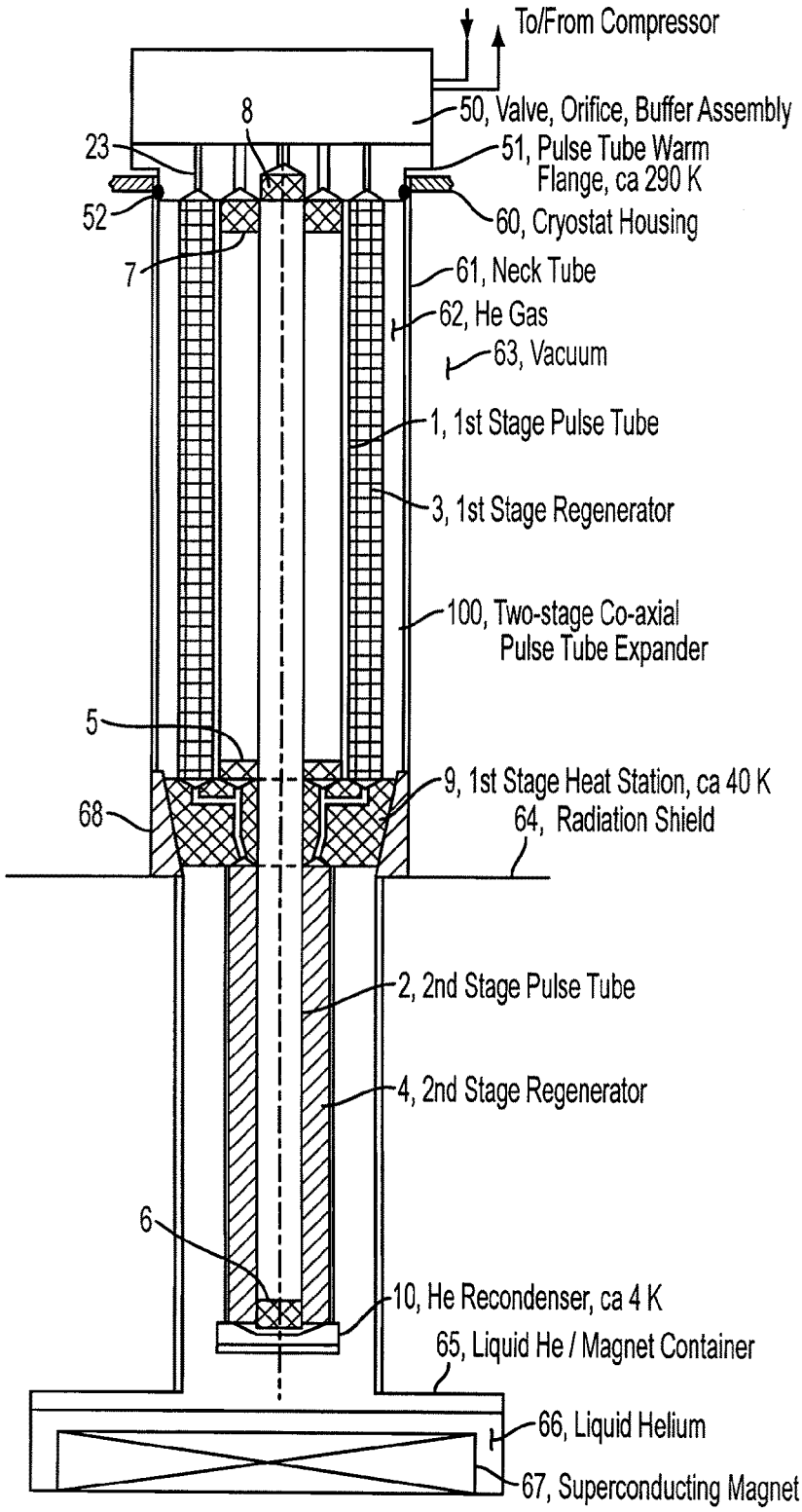
FIG. 1 is a schematic of the present invention which shows a two-stage co-axial pulse tube mounted in the neck tube of a MRI cryostat where it is surrounded by helium gas, has a heat station at about 40 K to cool a shield, and has a helium recondenser at about 4 K.

This invention provides a means to minimize thermal losses where a two-stage pulse tube is mounted in the neck tube of a liquid helium cooled MRI magnet. As shown in FIG. 1 a co-axial pulse tube is inserted in the neck tube where it is surrounded by gaseous helium that has a temperature gradient from room temperature, about 290 K, at the top to 4 K at the bottom. The pulse tube expander has a first stage heat station at about 40 K that is used to cool a shield in the magnet cryostat and a helium recondenser at the second stage.

Having the pulse tube expander in the neck tube provides an easy way to remove it for service. The co-axial design is more compact than the conventional parallel tube design thus the neck tube can have a smaller diameter, and convective losses due to heat transfer between the pulse tubes and regenerators are eliminated.

Referring to FIG. 1, the MRI cryostat consists of an outer housing 60 that is connected to inner vessel 65 by neck tube 61. Vessel 65 contains liquid helium 66 and the superconducting MRI magnet 67 and is surrounded by vacuum 63. Gaseous helium 62 fills the neck tube. A conventional MRI cryostat has a radiation shield 64 that is cooled to about 40 K through neck tube heat station 68 by the first stage of co-axial pulse tube expander 100.

Expander 100 consists of first stage pulse tube 1 surrounded by first stage regenerator 3 and extending from warm flange 51 to first stage heat station 9; a second stage pulse tube 2, surrounded by second stage regenerator 4 below first stage heat station 9, and surrounded by first stage pulse tube 1 above first stage heat station 9; helium recondenser 10 at the cold end of second stage pulse tube 2; flow smothers 6 and 8 at the cold and warm ends respectively of pulse tube 2; flow smoothers 5 and 7 at the cold and warm ends respectively of pulse tube 1; gas ports 23 in valve/orifice/buffer volume assembly 50 that connect to regenerator 3, pulse tube 1, and pulse tube 2.

Assembly 50 may have a single gas line connected to a Stirling type compressor or two gas lines for connection to a GM type compressor. Heat station 9 is shown as being conically shaped to mate with a similarly shaped receptacle in neck tube 61. Radial "O" ring 52 enables pulse tube 100 to be inserted into neck tube 61 until pulse tube heat station 9 is thermally engaged with neck tube heat station 68. It is typical to construct pulse tubes 1 and 2, and the shells for regenerators 3 and 4, from thin walled SS tubes to minimize axial conduction losses. Other options are discussed in connection with subsequent figures.

Figure 2:
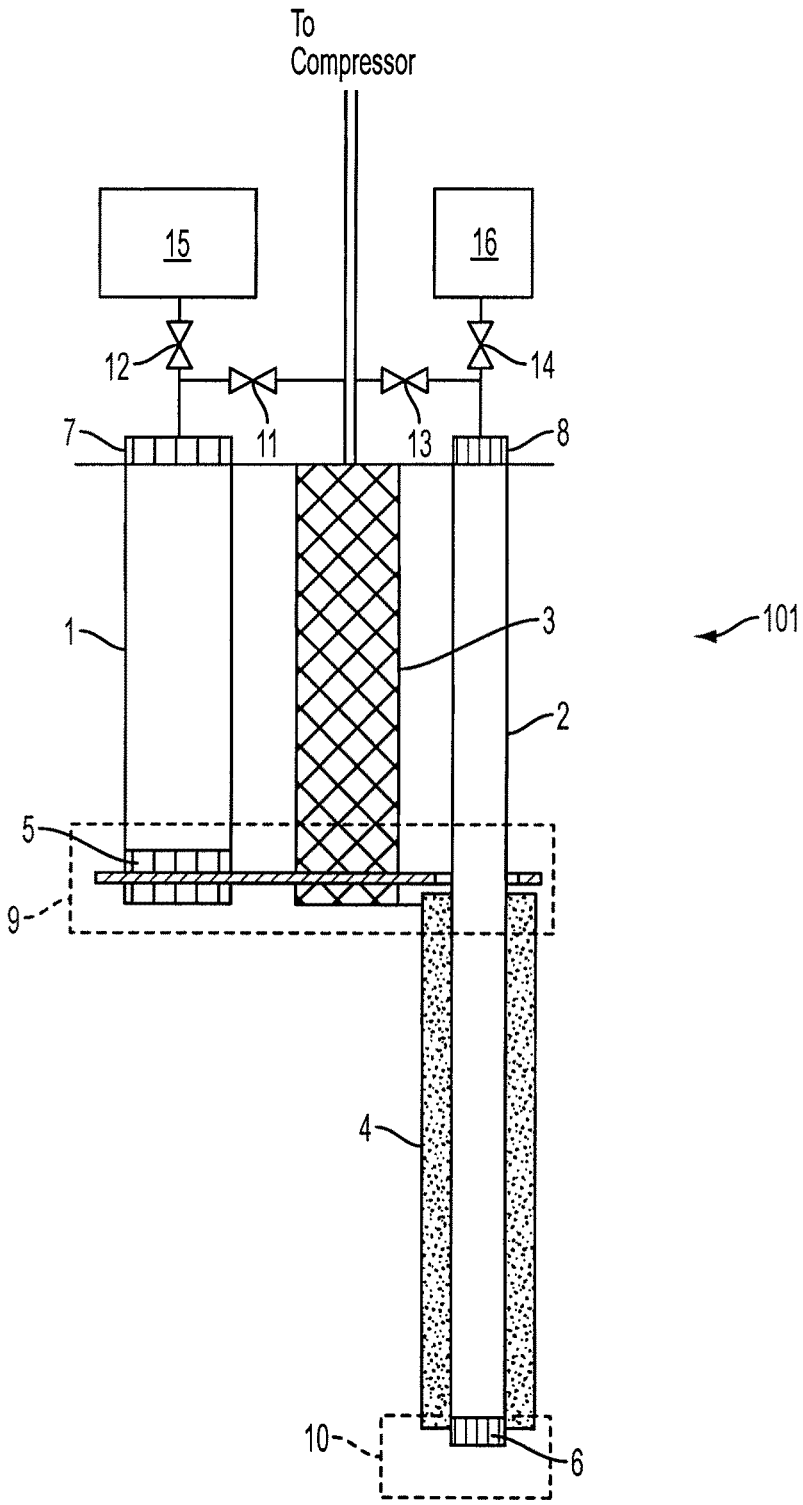
FIG. 2 is a schematic of a two stage pulse tube per the present invention in which the second stage pulse tube and regenerator are co-axial but the first stage has the conventional arrangement with the pulse tubes and regenerators separate and parallel. Double orifice control per Zhu is shown. The connection to the compressor can be either through main valves that switch flow to the regenerator per GM cycle operation, or the connection to the compressor can be direct per Stirling cycle operation.

FIG. 2 is a schematic of two-stage pulse tube 101 in which the second stage pulse tube 2 and second stage regenerator 4 are co-axial but first stage pulse tube 1 and regenerator 3 are conventionally arranged with the pulse tubes and regenerators separate and parallel. Double orifice control, as described in S. Zhu and P. Wu, '*Double inlet pulse tube refrigerators: an important improvement*', Cryogenics, vol. 30, 1990, p. 514, is shown, consisting of orifices 11 and 13 that connect the cycling flow from the compressor, either directly or through valves, to the warm ends of pulse tubes 1 and 2 respectively; orifice 12 that controls the flow rate of gas between pulse tube 1 and buffer volume 15; and orifice 14 that controls the flow rate of gas between pulse tube 2 and buffer volume 16. Other components have the same number identification as in FIG. 1.

FIG. 3*b* shows a conventional two-stage 4 K GM type pulse tube surrounded by vacuum. FIG. 3*a* shows the temperature profiles that are typical for such systems.

The temperature differences between the pulse tubes and the first stage regenerator are greater than the second stage temperature differences but the convection losses in a helium filled neck tube are more significant at the second stage than the first stage because the helium is significantly denser, thus the mass circulation rate is higher. Furthermore, a loss of 0.1 W at 4 K is equivalent to a loss of 1.1 W at 40 K in terms of input power.

Figure 4:
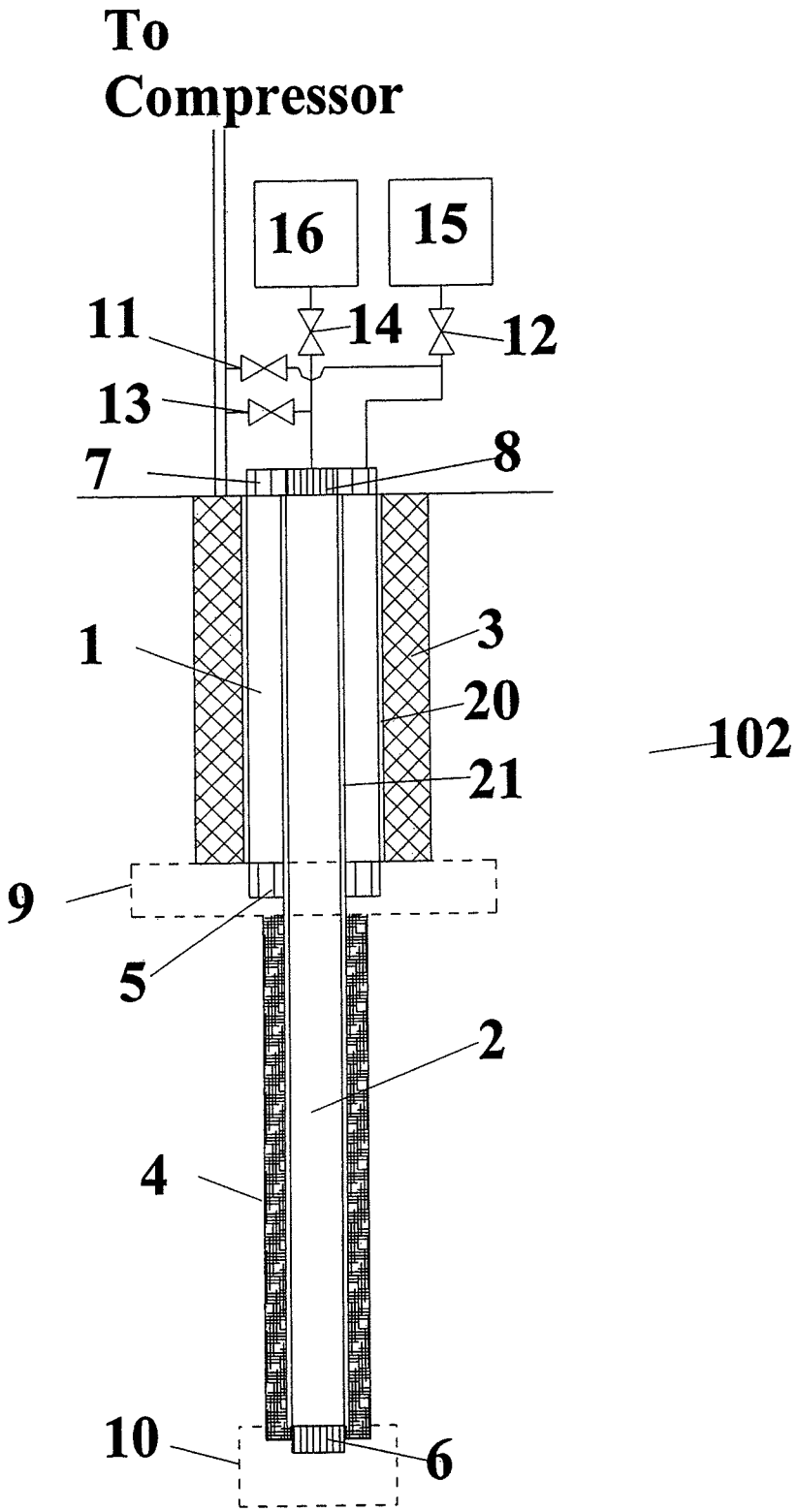
FIG. 4 shows the same arrangement as the co-axial pulse tube in FIG. 1 except that the walls of the pulse tubes are thick.

FIG. 4 shows two-stage co-axial pulse tube 102. Like numbers refer to like parts in FIGS. 1 and 2. First stage pulse tube 20 and second stage pulse tube 21 use heavy wall tubing that has low thermal conductivity which serves to reduce the heat loss between the pulse tubes in the first stage and between the pulse tubes and the regenerators in both stages. Plastic materials with cotton, linen, or glass cloth reinforcement are good choices.

In one preferred embodiment of the invention glass cloth is utilized. Although glass cloth does not have as low a thermal conductivity as the other fabrics it has the best dimensional stability and strength. In yet another embodiment, two thin walled stainless steel tubes with vacuum in between is utilized to provide insulation.

One of the objects of this invention is to reduce the vibration that is transmitted to an MRI cryostat by the expander. This is accomplished through the utilization of heavy walled pulse tubes. These significantly reduce vibration if they are always in compression. This embodiment eliminates the stretching of the pulse tubes and regenerators due to the pressure cycling that is inherent in the refrigeration process. Not only is mechanical vibration reduced but also disturbance of the magnetic field due to motion of the rare earth regenerator material in the second stage regenerator is reduced. Magnetic disturbance still occurs due to temperature cycling of the rare earth material.

Figure 5:
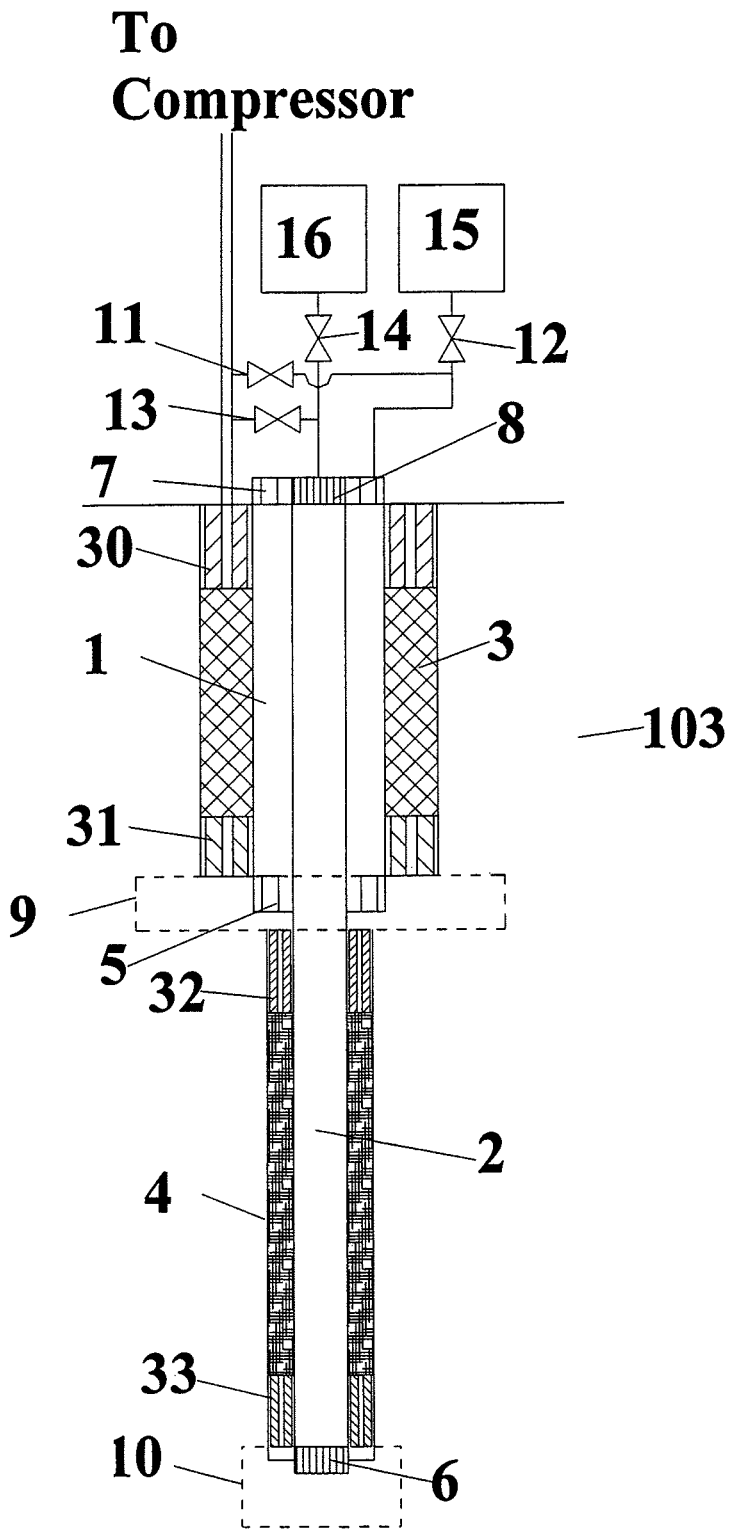
FIG. 5 shows a two-stage co-axial pulse tube in which spacers have been inserted at the ends of the regenerators to get a better match of the temperature profiles of the pulse tubes and the regenerators.

FIG. 5 is a schematic of two-stage co-axial pulse tube 103 in which spacers have been inserted at the ends of the regenerators to provide a better match of the temperature profiles of the pulse tubes and the regenerators. Like numbers refer to like parts in FIGS. 1, 2, and 4. Inserts 30 and 31 are shown at the warm end and cold end of regenerator 3 respectively. Similarly, inserts 32 and 33 are shown at the warm end and cold end of regenerator 4 respectively.

In conventional pulse tubes that operate in vacuum, the length and diameter of the pulse tubes and regenerators can be optimized almost independently of each other. However, the internal heat transfer between the pulse tubes and the regenerators in a co-axial design means that other factors have to be considered in the design. The use of inserts provides an important option for optimizing the design of a co-axial pulse tube.

Figure 6:
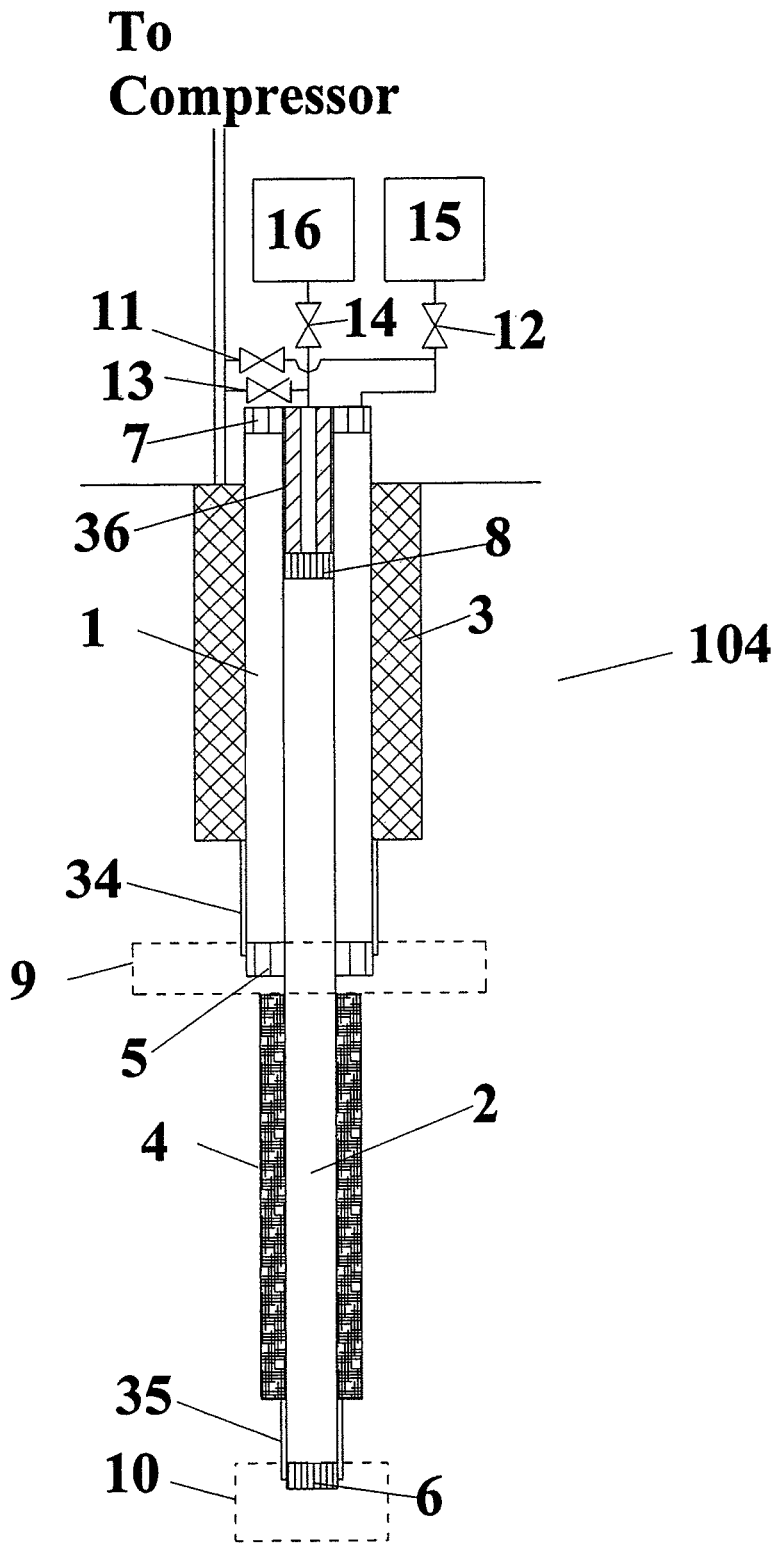
FIG. 6 shows another means to shift the temperature profiles of the pulse tubes relative to the regenerators to reduce thermal losses.

FIG. 6 is a schematic of two-stage co-axial pulse tube 104 in which spacers 31 and 33 in FIG. 5 have been replaced by annular gas passages 34 and 35 respectively. Like numbers refer to like parts in prior FIGS. Insert 36 at the warm end of second stage pulse tube 2, which is centered in pulse tube 1, provides a means to get a better match of the temperature profiles at the warm ends of the two pulse tubes.

Figure 7:
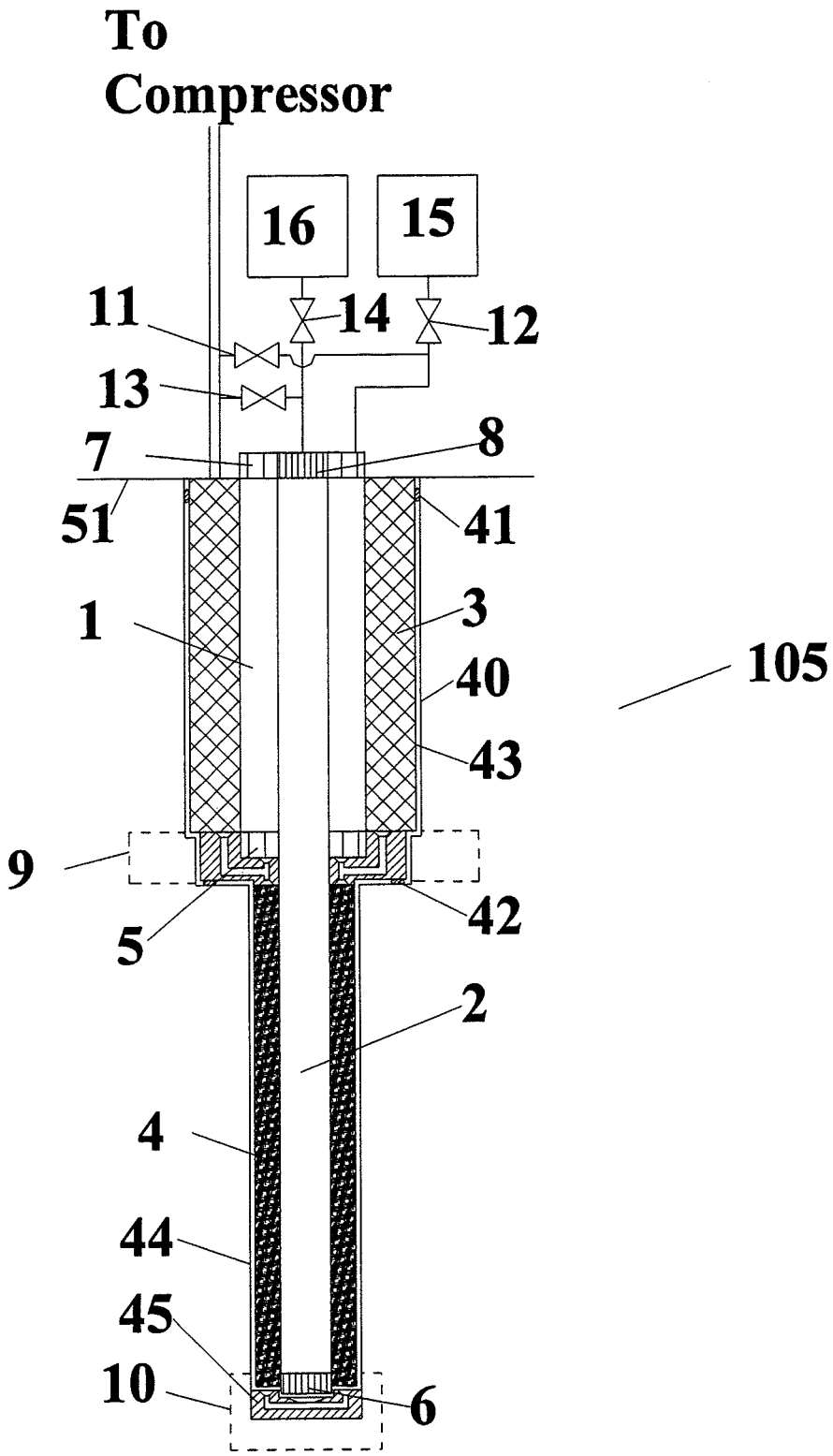
FIG. 7 shows a two-stage co-axial pulse tube construction in which the internal components are contained in a cartridge that plugs into a separate shell.

FIG. 7 is a schematic of two-stage co-axial pulse tube 105 in which the internal components are assembled as a cartridge that is inserted into a sleeve. Like numbers refer to like parts in prior FIGS. The parts that are included in removable cartridge 43 include first stage pulse tube 1, regenerator 3, flow smoothers 5 and 7; second stage pulse tube 2, regenerator 4, and flow smoothers 6 and 8. Cartridge 43 has a thin walled shell that provides a gas tight seal along the length of the assembly but not at the cold end. Outer shell 40 extends from pulse tube warm flange 51 to second stage heat station 10. Gas is prevented from flowing between cartridge 43 and shell 40 by seals 41 and 42. Heat is transferred from the heat station 9, which is part of shell 40, by means of a close gap 44 between the heat transfer surface 45 that is an integral part of flow smoother 5, and 9. Gas flows through slots in heat station 10 as it flows between regenerator 4 and flow smoother 6.

The advantage in this design is the simplification of packing second stage regenerator 4 and in providing easy access for service.

What is claimed is:

1. A pulse tube expander for a cryostat, the expander comprising:

an elongated pulse tube comprising a warm end and a cold end, the warm end of the elongated pulse tube connected to a buffer assembly and the cold end of the elongated pulse tube connected to a helium condenser;

a first stage pulse tube comprising a warm end and a cold end, the warm end of the first stage pulse tube connected to the buffer assembly and the cold end of the first stage pulse tube connected to a first stage heat station, the warm end of the elongated pulse tube being proximate to the warm end of the first stage pulse tube;

a spacer for spacing apart a first stage regenerator and a second stage regenerator, a first distance between the warm end of the elongated pulse tube and the spacer defines a first portion and a second distance between the cold end of the elongated pulse tube and the spacer defines a second portion;

the first stage regenerator disposed in the first portion;

the second stage regenerator disposed in the second portion; and the first stage pulse tube disposed co-axially with the elongated pulse tube and the first stage regenerator, the first stage pulse tube being disposed between the elongated pulse tube and the first stage regenerator, the first stage pulse tube being in direct contact with the elongated pulse tube and the first stage regenerator.

2. The expander of claim 1, wherein the spacer comprises a heat station.

3. The expander of claim 1, wherein at least one pulse tube is thermally coupled to a heat shield in the cryostat.

4. The expander of claim 1, wherein the elongated pulse tube and the second stage regenerator are co-axial.

5. The pulse tube expander of claim 1, wherein the first and second portions comprise different temperature gradients that coincide with the respective first and second stage regenerators.

6. A pulse tube expander for a cryostat, the expander comprising:

a first stage pulse tube comprising a warm end and a cold end, the warm end of the first stage pulse tube connected to a buffer assembly and the cold end of the first stage pulse tube connected to a first stage heat station;

a second stage pulse tube comprising a warm end and a cold end, the warm end of the second stage pulse tube connected to the buffer assembly and the cold end of the second stage pulse tube to a second stage heat station, the second stage pulse tube disposed co-axially within the first stage pulse tube and directly adjacent to the first stage pulse tube, the warm end of the second stage pulse tube being proximate to the warm end of the first stage pulse tube, the second stage pulse tube comprising an extended portion that extends beyond the cold end of the first stage pulse tube;

a first stage regenerator surrounding a first portion of the first stage pulse tube;

a second stage regenerator surrounding a second portion of the second stage pulse tube; and a plurality of single wall tubes separating the regenerators and the pulse tubes.

7. The expander of claim 6, wherein a distance between a warm end of the first stage regenerator and the warm end of the first stage pulse tube is occupied by a no gap, a spacer, a heat exchanger, a spacer channel or a combination thereof.

8. The expander of claim 6, wherein a distance between a cold end of the first stage regenerator and the cold end of the first stage pulse tube is occupied by a no gap, a spacer, a heat exchanger, a spacer channel or a combination thereof.

9. The expander of claim 6, wherein the distance between a warm end of the second stage regenerator and the cold end of the first stage pulse tube is occupied by a no gap, a spacer, a heat exchanger, a spacer channel or a combination thereof.

10. The expander of claim 6, wherein the distance between a cold end of the second stage regenerator and the cold end of the second stage pulse tube is occupied by a no gap, a spacer, a heat exchanger, a spacer channel or a combination thereof.

* * * * *